US010435870B2

(12) United States Patent
Narikawa et al.

(10) Patent No.: US 10,435,870 B2
(45) Date of Patent: Oct. 8, 2019

(54) CONSTRUCTION MACHINE

(71) Applicant: HITACHI CONSTRUCTION MACHINERY CO., LTD., Tokyo (JP)

(72) Inventors: Ryu Narikawa, Tokyo (JP); Hidekazu Moriki, Tokyo (JP); Yasutaka Tsuruga, Tsuchiura (JP); Hiroshi Sakamoto, Tsuchiura (JP); Shiho Izumi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 15/764,425

(22) PCT Filed: Oct. 5, 2016

(86) PCT No.: PCT/JP2016/079658
§ 371 (c)(1),
(2) Date: Mar. 29, 2018

(87) PCT Pub. No.: WO2017/061485
PCT Pub. Date: Apr. 13, 2017

(65) Prior Publication Data

US 2018/0266083 A1 Sep. 20, 2018

(30) Foreign Application Priority Data

Oct. 8, 2015 (JP) ..... 2015-200531

(51) Int. Cl.
*E02F 9/26* (2006.01)
*E02F 3/43* (2006.01)
(Continued)

(52) U.S. Cl.
CPC ..... *E02F 9/265* (2013.01); *E02F 3/425* (2013.01); *E02F 3/435* (2013.01); *E02F 9/2033* (2013.01);
(Continued)

(58) Field of Classification Search
CPC .... F02D 2200/101; F02D 29/00; F02D 29/04; G01C 15/00; G01C 21/165
See application file for complete search history.

(56) References Cited

U.S. PATENT DOCUMENTS 5,835,874 A * 11/1998 Hirata ..... E02F 3/435 701/50
6,169,948 B1 1/2001 Fujishima et al.
(Continued)

FOREIGN PATENT DOCUMENTS

EP 0 707 118 B1 7/1999
EP 2 685 010 B1 1/2019
(Continued)

OTHER PUBLICATIONS

International Preliminary Report on Patentability received in corresponding International Application No. PCT/JP2016/079658 dated Apr. 19, 2018.
(Continued)

*Primary Examiner* — Thomas G Black
*Assistant Examiner* — Ce Li Li
(74) *Attorney, Agent, or Firm* — Mattingly & Malur, PC

(57) ABSTRACT

A hydraulic excavator includes: a hydraulic pump driven by power generated by an engine; a work device that operates by a plurality of hydraulic cylinders driven by power generated by the hydraulic pump; an actuator control section that controls the boom cylinder in such a manner that a tip end of a bucket is located on or above a target surface; a control point position calculation section that calculates a bucket claw tip position on the basis of angle sensors; and a power generator control section that imposes more limitations on output power ranges of the engine and the hydraulic pump when a distance between the claw tip position and the target surface is equal to or smaller than a threshold D than those when the distance between the claw
(Continued)

tip position and the target surface is larger than the threshold D.

9 Claims, 9 Drawing Sheets

(51) Int. Cl.

| | |
|---|---|
| ***E02F 3/42*** | (2006.01) |
| ***E02F 3/32*** | (2006.01) |
| ***E02F 9/22*** | (2006.01) |
| ***F02D 29/04*** | (2006.01) |
| ***F02D 29/00*** | (2006.01) |
| ***E02F 9/20*** | (2006.01) |

(52) U.S. Cl.
CPC ..... *E02F 9/2066* (2013.01); *E02F 9/2232* (2013.01); *E02F 9/2235* (2013.01); *E02F 9/2296* (2013.01); *F02D 29/00* (2013.01); *F02D 29/04* (2013.01); *E02F 3/32* (2013.01); *F02D 2200/101* (2013.01)

(56) References Cited

U.S. PATENT DOCUMENTS

| | | | | |
|---|---|---|---|---|
| 2013/0345939 | A1 | 12/2013 | Magaki et al. | |
| 2016/0040398 | A1* | 2/2016 | Kitajima | E02F 3/435 701/50 |
| 2016/0097184 | A1 | 4/2016 | Matsuyama et al. | |
| 2016/0138240 | A1* | 5/2016 | Ikegami | E02F 9/2285 701/50 |
| 2016/0244950 | A1* | 8/2016 | Kami | E02F 9/2033 |
| 2016/0251824 | A1* | 9/2016 | Arimatsu | E02F 3/435 701/50 |
| 2016/0251835 | A1* | 9/2016 | Kitajima | E02F 3/3663 701/50 |
| 2016/0265187 | A1* | 9/2016 | Baba | E02F 3/435 |
| 2016/0273186 | A1* | 9/2016 | Kami | E02F 3/435 |
| 2016/0273194 | A1* | 9/2016 | Ikegami | E02F 3/435 |
| 2016/0281331 | A1* | 9/2016 | Ikegami | E02F 9/2228 |
| 2016/0289928 | A1* | 10/2016 | Kitajima | E02F 3/32 |

FOREIGN PATENT DOCUMENTS

| | | | |
|---|---|---|---|
| JP | 10-8490 | A | 1/1998 |
| JP | 10-252521 | A | 9/1998 |
| JP | 3056254 | B2 | 6/2000 |
| JP | 2005-60970 | A | 3/2005 |
| JP | 2006-17195 | A | 1/2006 |
| JP | 2011-43002 | A | 3/2011 |
| WO | 2012/121252 | A1 | 9/2012 |
| WO | 2014/167718 | A1 | 10/2014 |
| WO | 2015/137525 | A1 | 9/2015 |

OTHER PUBLICATIONS

International Search Report of PCT/JP2016/079658 dated Dec. 27, 2016.

Extended European Search Report received in corresponding European Application No. 16853639.9 dated May 9, 2019.

* cited by examiner

CONSTRUCTION MACHINE

TECHNICAL FIELD

The present invention relates to a construction machine.

BACKGROUND ART

There is known a hydraulic excavator as a typical construction machine. The hydraulic excavator is configured with a multijoint type front work device that includes a boom, an arm, and a bucket (work devices) each rotatable in a perpendicular direction, and a machine body that includes an upper swing structure and a lower travel structure. Each section of the front work device is supported rotatably. Owing to this, when a linear finished surface (target excavation surface) is formed, for example, by a tip end of the bucket while an arm crowding operation toward the machine body is performed, then an operator needs to actuate the sections of the front work device in a combined fashion to make linear a locus of the tip end of the bucket and is required to have expertise.

To address the need, Patent Document 1, for example, discloses a technique for automatically changing a boom angle in such a manner that an orbit (excavation orbit) of the tip end of the bucket travels along the target excavation surface (also referred to as target surface) during excavation work as a support device for carrying out linear excavation. A function to automatically or semi-automatically control the actuators in response to operator's operation and to actuate the objects to be driven such as the boom, the arm, the bucket, and the upper swing structure is referred to as machine control.

Patent Document 1 describes that control means of the excavation support device changes a boom rotation angle in response to a change of an arm rotation angle so that the bucket tip end moves on the excavation orbit when the arm moves in an excavation direction, and changes the boom rotation angle in response to the change of the arm rotation angle so that the bucket tip end moves above the excavation orbit by a predetermined height when the arm moves in an opposite direction to the excavation direction.

Meanwhile, a necessary engine speed of an engine and necessary power (pump horsepower) of a hydraulic pump in the hydraulic excavator vary depending on a content of work; thus, it is preferable to change power of these power generators to appropriate values as needed. Operating the hydraulic excavator at an inappropriate engine speed and inappropriate pump power causes an increase of fuel consumption and a deterioration of operability. The engine speed can be manually adjusted by an engine control dial installed in an operation room. Generally, however, an operator often grips two operation levers by two hands, so that it is not easy for the operator to adjust the engine control dial in the state. Furthermore, it is difficult for the operator in the course of carrying out work to determine an optimum engine speed in response to the work by himself/herself.

Patent Document 2, for example, describes a control system for an engine and a hydraulic pump of a construction machine such as a hydraulic excavator, wherein a controller reads an engine load factor from an engine control section that controls an electronically-controlled fuel injection pump of the engine, calculates an effective engine load factor by performing a stabilization process, selects a work mode suitable for a content of work with the effective engine load factor used as a parameter, issues a command to change over the work mode when a sensor detects that an operation lever of a work actuator is not operated, and controls states of the engine and the hydraulic pump in such a manner that an engine speed and hydraulic pump input horsepower are equal to those corresponding to the work mode.

PRIOR ART DOCUMENTS

Patent Documents

Patent Document 1: JP-2011-043002-A
Patent Document 2: JP-1998-252521-A

SUMMARY OF THE INVENTION

Problem to be Solved by the Invention

In a case of automatically changing the boom angle by the machine control (control of this type is often referred to as area limiting excavation control) in such a manner that the excavation orbit of the bucket tip end travels along the target excavation surface, actual excavation work can be classified into (1) "rough excavation work" for roughly unearthing the target excavation surface and (2) "finishing work" for finishing excavation according to the target excavation surface. It is preferable to quickly move a bucket claw tip for improving work efficiency in the rough excavation work, while it is preferable to reduce a speed of the bucket claw tip and precisely move the bucket claw tip in the finishing work so that the bucket claw tip moves along the target excavation surface.

It is preferable to increase the engine speed to ensure a work speed in the rough excavation work, while it is preferable to reduce the engine speed and reduce the speed of the bucket claw tip to ensure precision for a position of the claw tip in the finishing work. Owing to this, if the engine speed is kept high with the rough excavation work taking precedence over the finishing work, then wasteful consumption of fuel occurs during the finishing work, and demand of energy saving is not satisfied. Conversely, if the engine speed is kept low with the finishing work and the energy saving taking precedence over the rough excavation work, then the work speed is reduced to make it impossible to ensure the work speed required in the rough excavation work.

Furthermore, in the finishing work required of high precision, the finishing work is not completed by one arm crowding operation but it is necessary to carry out the finishing excavation a plurality of times. For that reason, it is desirable to increase actuator speeds to improve the work efficiency even in the finishing work when the bucket is returned to an excavation start point by means of an arm dumping operation. Moreover, to ensure control precision over the bucket claw tip in the finishing work, reducing the engine speed enables a reduction of operation gains of the actuators with respect to spool strokes and facilitates controlling the bucket tip end.

Generally, arm operation and swing operation are allocated to one (first lever) of two operation levers, and boom operation and bucket operation are allocated to the other lever (second lever). Even if the boom is automatically controlled by the machine control during the excavation work by means of arm crowding and return work by means of arm dumping as disclosed in Patent Document 1, it is necessary to locate the bucket at a position at which a bucket angle is in an optimum state with respect to the excavation surface using the second lever while the operator operates the arm using the first lever. This means that operator's operating the actuator using the second lever is not completely eliminated although the operator does not need to operate the boom using the second lever. It is thus difficult to let go of one operation lever and adjust the engine control dial during a series of excavation work.

In addition, an operating speed of the work device can be also changed when output power of the hydraulic pump serving as a system is changed by changing a tilting angle of the hydraulic pump or by changing the number of hydraulic pumps actuated by an excavator that mounts a plurality of hydraulic pumps. Owing to this, it is preferable to adjust an output power range of the hydraulic pump or hydraulic pumps as an alternative to or in addition to adjustment of the engine speed. Naturally, however, the engine control dial can adjust only the engine speed and cannot adjust the hydraulic pump output power.

Next, the control system for the engine and the hydraulic pump of the construction machine described in Patent Document 2 sets a stabilization area and a changeover area for changeover of the work mode, and changes over the mode when the effective engine load factor is located in the changeover area for certain time or longer in the current work mode. Owing to this, the control system is configured such that once the work mode is changed over to another, the work mode is not changed over to the original work mode until the passage of the certain time even in a situation in which the work mode should be returned to the original work mode as soon as possible. In addition, the control system is configured such that the work mode is not changed over while the lever is operated. Owing to this, the engine speed is kept low in, for example, the light-load finishing work such that the bucket is moved to the excavation start point by moving the arm in an arm dumping direction right after finishing work is carried out by means of an arm crowding operation and excavation is carried out again by means of arm crowding in a series of excavation work. Owing to this, it is desirable that a moving speed at which the bucket moves to the excavation start point by the operation in the arm dumping direction is high. However, the moving speed decreases during the heavy load rough excavation work since the engine speed is kept low.

In this way, even with the use of the technique of Prior Art Document 2, it is impossible to exercise appropriate control over the engine speed and the pump input horsepower in response to an operating situation.

While a case in which a drive source of the hydraulic pump is the engine is shown by way of example, the problems described above are common to a construction machine that uses a prime mover such as an electric motor or a generator motor other than the engine.

An object of the present invention is to provide a construction machine that can exercise control over power of at least one of a prime mover including an engine and a hydraulic pump in response to a work situation in a series of excavation work while machine control is executed.

Means for Solving the Problem

To attain the object, the present invention provides a construction machine including: a prime mover; a hydraulic pump driven by power generated by the prime mover; a work device that operates by a plurality of hydraulic actuators driven by power generated by the hydraulic pump, the work device including a work tool on a tip end thereof; and an actuator control section that controls at least one of the plurality of hydraulic actuators in such a manner that a tip end of the work tool is located on or above a target surface that is arbitrarily set. The construction machine includes: a control point position calculation section that calculates a position of a control point set with respect to the work device on the basis of quantities of state related to a position and a posture of the work device; and a power generator control section that, when a distance between the target surface and the control point calculated on the basis of the position of the control point and a position of the target surface is equal to or smaller than a threshold, executes output power limiting control that is a process for imposing more limitations on an output power range of at least one of the prime mover and the hydraulic pump than those when the distance between the target surface and the control point is larger than the threshold.

Effect of the Invention

According to the present invention, the power of at least one of the prime mover including the engine and the hydraulic pump is controlled in response to the work situation in a series of excavation work while the machine control is executed; thus, it is possible to achieve energy saving while ensuring a work speed and control precision necessary for work.

MODES FOR CARRYING OUT THE INVENTION

First Embodiment

A first embodiment of the present invention will be explained with reference to FIGS. 1 to 4.

Figure 1:
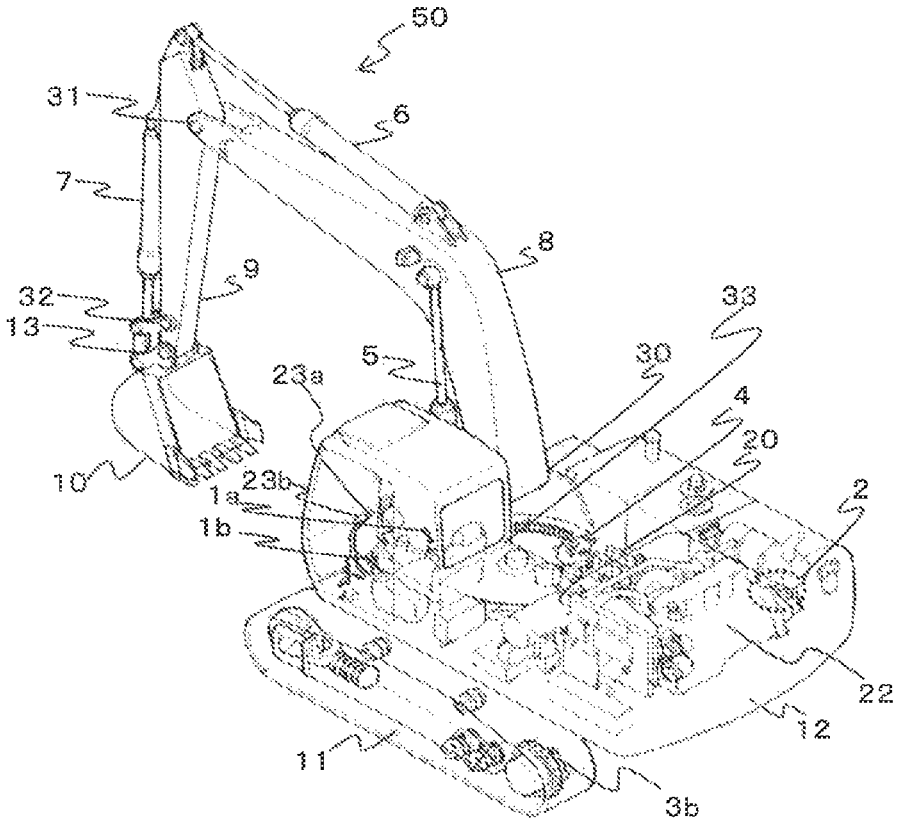
FIG. 1 is a configuration diagram of a hydraulic excavator according to embodiments of the present invention.

FIG. 1 is a configuration diagram of a hydraulic excavator according to the first embodiment of the present invention. The hydraulic excavator shown in FIG. 1 is configured with a multijoint type front work device 50 that includes a boom 8, an arm 9, and a bucket (work tool) 10 each rotatable in a perpendicular direction, and a machine body that includes an upper swing structure 12 and a lower travel structure 11. A base end portion of the boom 8 of the front work device 50 is rotatably supported by the upper swing structure 12, and the bucket 10 is located on a tip end of the front work device 50. While a case in which the work tool (attachment) attached to the tip end of the front work device 50 is the bucket 10 is illustrated by way of example, it goes without saying that the present embodiment is also applicable to cases in which the work tool is replaced by other work tools.

An engine (prime mover) 22 and a hydraulic pump 2 that is driven by power generated by the engine 22 are mounted on the upper swing structure 12. A hydraulic fluid generated by the hydraulic pump 2 is supplied to a boom cylinder 5, an arm cylinder 6, and a bucket cylinder 7, whereby the sections of the front work device 50 are appropriately driven to operate by the plurality of hydraulic actuators 5, 6, and 7, respectively.

A right operation lever 1*a*, a left operation lever 1*b*, a travel right lever 23*a*, and a travel left lever 23*b* are provided in a cabin on the upper swing structure 12. It is noted that the right operation lever 1*a* and the left operation lever 1*b* are often generically referred to as operation levers 1 and the travel right lever 23*a* and the travel left lever 23*b* are often generically referred to as travel levers 23, hereinafter.

When an operator operates the travel right lever 23*a*, the travel left lever 23*b*, the right operation lever 1*a*, or the left operation lever 1*b*, a pilot pressure (hereinafter, referred to as operating pressure) for controlling the hydraulic pump 2 and a control valve 20 in response to a lever operation amount (for example, lever stroke) of the lever is generated. The hydraulic fluid delivered from the hydraulic pump 2 is supplied to a travel right hydraulic motor 3*a*, a travel left hydraulic motor 3*b*, a swing hydraulic motor 4, the boom cylinder 5, the arm cylinder 6, and the bucket cylinder 7 via the control valve 20. The boom cylinder 5, the arm cylinder 6, and the bucket cylinder 7 expand or contract by the hydraulic fluid supplied from the hydraulic pump 2, whereby the boom 8, and arm 9, and the bucket 10 rotate and a position and a posture of the bucket 10 change. As a result, operator's operating the right operation lever 1*a* or the left operation lever 1*b* drives the target section of the front work device 50 and realizes a desired movement of the front work device 50. Furthermore, the swing hydraulic motor 4 rotates by the hydraulic fluid supplied from the hydraulic pump 2, whereby the upper swing structure 12 swings with respect to the lower travel structure 11. Moreover, the travel right hydraulic motor 3*a* and the travel left hydraulic motor 3*b* rotate by the hydraulic fluid supplied from the hydraulic pump 2, whereby the lower travel structure 11 travels.

On the other hand, a boom angle sensor 30, an arm angle sensor 31, and a bucket angle sensor 32 are attached to a boom pin (not shown) about which the boom 8 rotates, an arm pin (not shown) about which the arm 9 rotates, and a bucket link that is a link mechanism for coupling the arm 9 with the bucket 10 so that rotation angles of the boom 8, the arm 9, and the bucket 10 can be measured, respectively. A machine body inclination sensor 33 is attached to the upper swing structure 12 so that longitudinal and lateral inclinations of the upper swing structure 12 can be measured.

Figure 2:
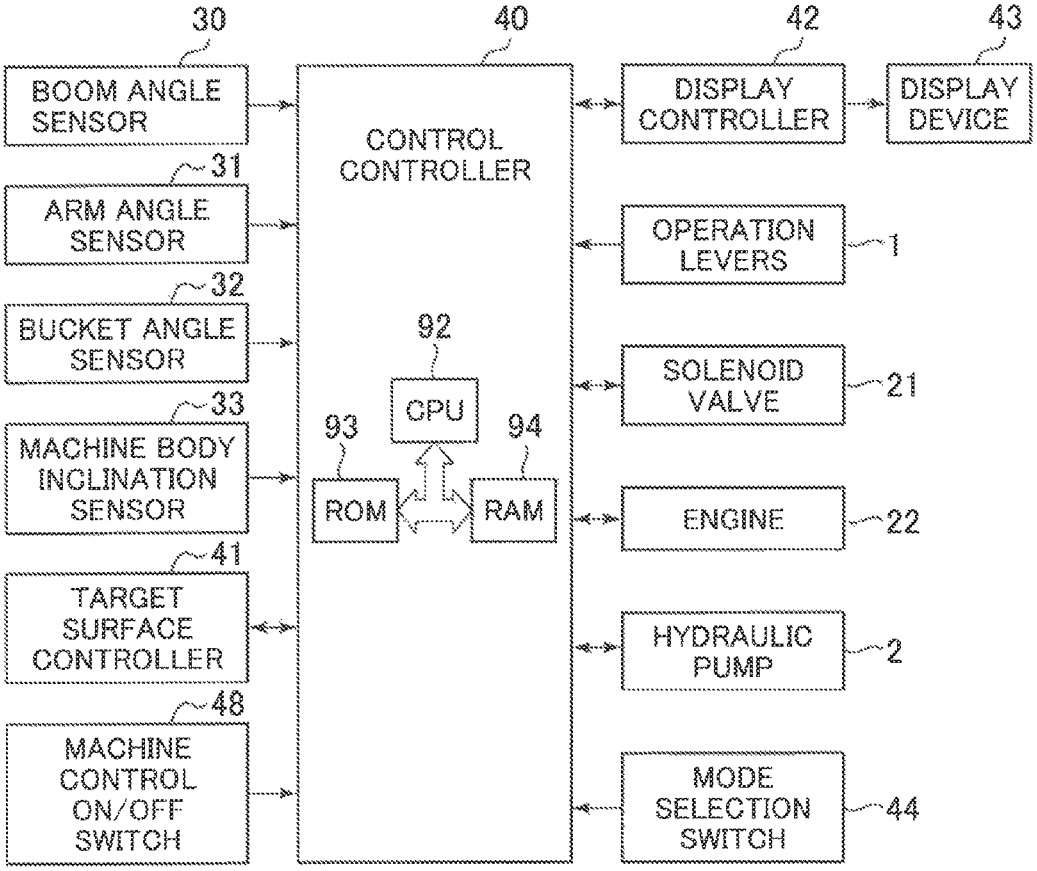
FIG. 2 is a configuration diagram of a control system according to a first embodiment of the present invention.

FIG. 2 is a configuration diagram of an excavation control system according to the present embodiment of the present invention. It is noted that the same elements as those in FIG. 1 are denoted by the same reference characters and are often not explained. The excavation control system shown in FIG. 2 includes a control controller 40 that is a computer (for example, a microcomputer) exercising control over the entire system, a target surface controller 41 that is a device including a computer exercising target surface setting control, and a display controller 42 that is a computer exercising display control over a display section (display device such as a liquid crystal monitor) 43.

The control controller 40 has a central processing unit (CPU) 92 that is a processor, a read only memory (ROM) 93 and a random access memory (RAM) 94 that are storage devices, and an input/output section (not shown) for transmitting and receiving data and signals to and from an external device to the control controller 40. While the other controllers 41 and 42 have hardware configurations each corresponding to a CPU, a ROM, a RAM, and an input/output section, only a configuration of the control controller 40 will be explained herein and a repetitive explanation will be omitted.

The ROM 93 is a recording medium in which a control program is stored, and the CPU 92 performs a predetermined computing process on signals input from the input/output section and the memories 93 and 94 in accordance with the control program stored in the ROM 93. The data and signals from the external device are input to and output from the input/output section, and the input/output section performs A/D conversion or D/A conversion as needed. For example, operation signals from the operation levers 1 and angle signals from the angle sensors 30, 31, and 32 and the machine body inclination sensor 33 are input to the input/output section, and the input/output section performs the A/D conversion on the input signals. In addition, the input/output section creates a signal for output in response to a computation result of the CPU 92, and outputs the signal to the display controller 42, a solenoid valve 21, the engine 22, and/or the hydraulic pump 2, thereby controlling the signal destination device or devices.

While the control controller 40 of FIG. 2 includes semiconductor memories that are the ROM 93 and the RAM 94 serving as the storage devices, the control controller 40 may include a magnetic storage device such as a hard disk drive and store the control program in this magnetic storage device.

The boom angle sensor 30, the arm angle sensor 31, the bucket angle sensor 32, and the machine body inclination sensor 33 that detect the rotation angles of the boom 8, the arm 9, and the bucket 10 and an inclination angle (machine body inclination angle) of the upper swing structure 12 as quantities of state related to a position and a posture of the work device 50 are connected to the control controller 40, and the detection angles of these angle sensors 30 to 33 are input to the control controller 40.

In addition, the target surface controller 41, the display controller 42, the operation levers 1, the solenoid valve 21, the engine 22, the hydraulic pump 2, a machine control ON/OFF switch (hereinafter, referred to as MC switch) 48, and a mode selection switch 44 are connected to the control controller 40.

The solenoid valve 21 is provided in a hydraulic line for the pilot pressure (operating pressure) explained with reference to FIG. 1, and the solenoid valve 21 can increase or reduce the operating pressure generated by operator's operating the operation levers 1 downstream.

The target surface controller 41 is a device for arbitrarily setting a target surface, and includes, for example, a plurality of switches or operation devices similar to the plurality of switches provided in or around a grip (grip section) of one of or each of the two operation levers 1. The target surface controller 41 of the present embodiment includes a setting switch (not shown) for use in setting a target excavation surface and a cancel switch (not shown) for cancelling the target surface set at a time. When the setting switch is depressed, a position of a claw tip of the bucket 10 at a time of depression is stored in the control controller 40. When a setting switch depressing operation is repeated, then two points are stored in the control controller 40, and the target surface is set by a line defined by the two points. On the other hand, when the cancel switch is depressed, the target surface set by the setting switch can be cancelled.

In the present embodiment, excavator reference coordinates are set on a plane that includes a swing central axis and that passes through a center of the front work device, and the target surface is set by selecting the two points on the reference coordinates. It is noted that the target surface is a surface that includes the two points described above and that is orthogonal to the reference coordinates. In addition, the excavator reference coordinates are set on the plane surface in the present embodiment. It is noted that the target surface controller 41 may be configured such that the target surface set by the setting switch is displayed as a schematic diagram on the display section (monitor) 43 or displayed as numeric values for the operator to be able to confirm the set target excavation surface.

Two changeover positions, that is, ON and OFF positions are prepared for the MC switch 48, and the MC switch 48 outputs a signal (ON/OFF signal of FIG. 3) for alternatively changing over between an ON-state and an OFF-state of machine control (area limiting excavation control) in response to the changeover position to the control controller 40.

When the MC switch 48 is at the ON position, the control controller 40 (an actuator control section 303 to be described later) controls the solenoid valve 21 in such a manner that the claw tip of the bucket 10 does not enter inside of the target excavation surface (an area below the target excavation surface), or executes so-called area limiting excavation control as the machine control. Conversely, when the MC switch 48 is at the OFF position, the control controller 40 (actuator control section 303) does not execute the area limiting excavation control.

When the machine control is turned on, the control controller 40 (actuator control section 303 to be described later) executes the area limiting excavation control for causing the solenoid valve 21 to control at least the boom cylinder 5 out of the three types of hydraulic cylinders 5, 6, and 7 in such a manner that the claw tip of the bucket 10 is located on or above the target excavation surface set by the target surface controller 41. This control can suppress the claw tip of the bucket 10 from entering the area below the target excavation surface and facilitate forming a fine target excavation surface whether the operator is skilled.

Furthermore, the control controller 40 is configured such that the control controller 40 can alternatively select a finishing mode (first mode) or a rough excavation mode (second mode) as an excavation mode while the area limiting excavation control is executed (the MC switch 48 is at the ON position). In the present embodiment, the mode selection switch (changeover device) 44 is provided as a device for the operator to be able to arbitrarily select the excavation mode. Two changeover switches for the finishing mode and the rough excavation mode are prepared for the mode selection switch 44, and the mode selection switch 44 outputs a signal (selection mode signal of FIG. 3) for alternatively changing over between the finishing mode and the rough excavation mode in response to the changeover position to the control controller 40. It is desirable that the mode selection switch 44 is provided in a location where the operator can easily operate the mode selection switch 44, such as in or around the grip section of the right operation lever 1*a* or the left operation lever 1*b* or in a console within the operation room.

Since an excavation speed takes precedence over excavation precision in the rough excavation mode, an actuator speed reduction rate with respect to operator's operation is controlled to be lower. For example, when leveling excavation is carried out by means of an arm crowding operation, the solenoid valve 21 is controlled in such a manner that an arm crowding speed corresponds to operator's input, and the solenoid valve 21 is also controlled in such a manner that a boom raising operation is performed for preventing the claw tip from entering the area below the target excavation surface. At this time, the solenoid valve 21 may be controlled in such a manner that the angle of the bucket 10 with respect to the target excavation surface is constant. On the other hand, since the excavation precision takes precedence over the excavation speed in the finishing mode, the hydraulic actuator speed reduction rate with respect to the operator's operation is higher than that in the rough excavation mode.

Figure 3:
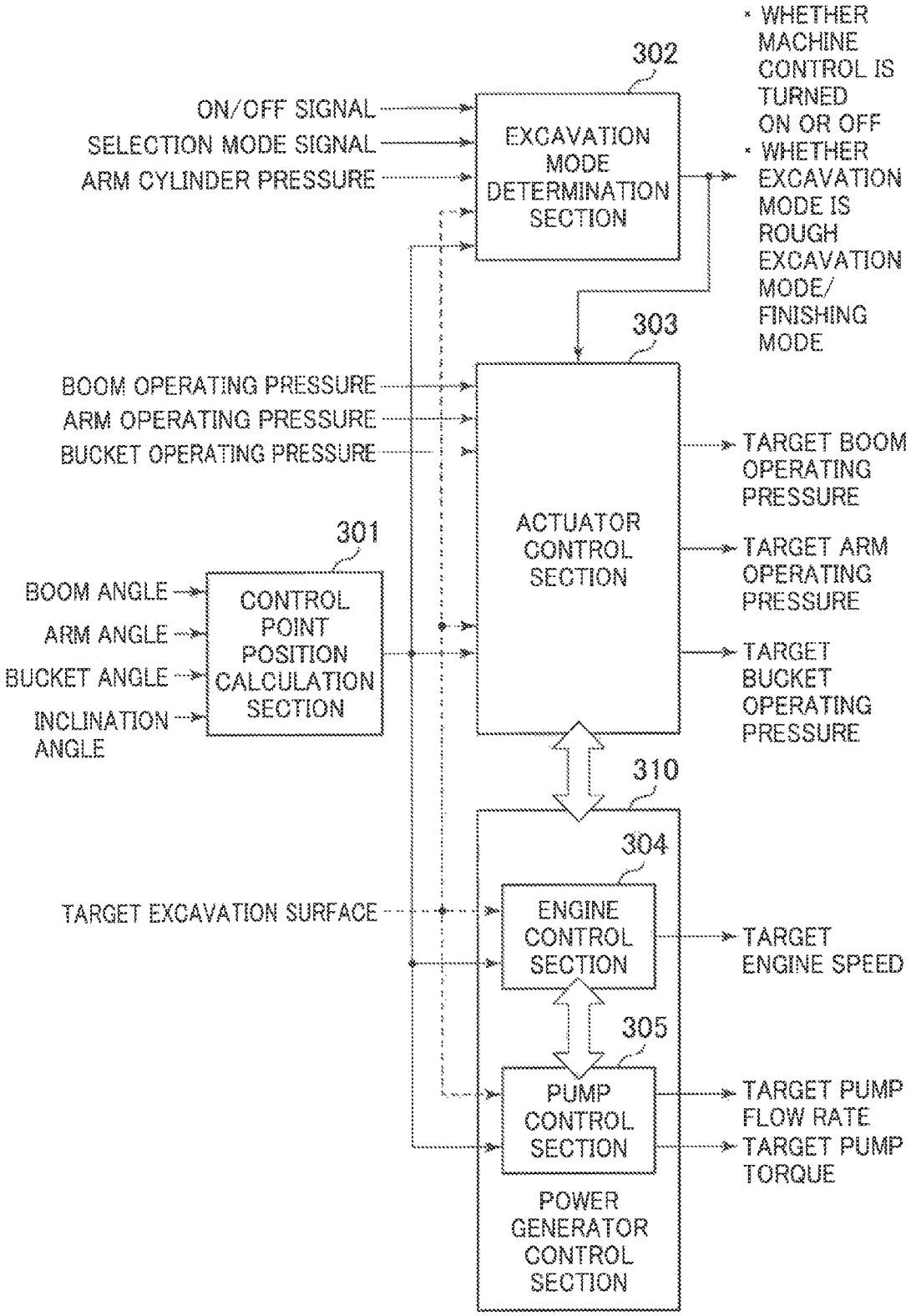
FIG. 3 is a functional block diagram of a control controller according to the first embodiment of the present invention.

FIG. 3 is a block diagram of functions executed by the control program stored in the ROM 93 of the control controller 40 according to the present embodiment of the present invention. As shown in FIG. 3, the control controller 40 functions as a control point position calculation section (claw tip position calculation section) 301, an excavation mode determination section 302, the actuator control section 303, an engine control section 304, and a pump control section 305. Among the sections, the engine control section 304 and the pump control section 305 are often generically referred to as power generator control section 310. It is noted that each of the sections shown in FIG. 3 may be configured as software that is the control program stored in the ROM 93 or may be configured as hardware that is a circuit or device. In the configurations, the two or more functions may be integrated or one function may be distributed to a plurality of functions.

The control controller 40 receives position information on the target excavation surface relative to the excavator reference coordinates from the target surface controller 41.

The control point position calculation section (claw tip position calculation section) 301 calculates a claw tip position of the bucket 10 relative to the excavator reference coordinates as a control point position in response to values detected by the boom angle sensor 30, the arm angle sensor 31, the bucket angle sensor 32, and the machine body inclination sensor 33. In the present embodiment, the claw tip of the bucket 10 is assumed as the control point. However, a point other than the claw tip may be the control point and the position of the control point may be calculated by the control point position calculation section 310 as long as the point is set to be associated with the front work device 50.

The excavation mode determination section 302 performs determination as to whether a machine control function is turned on or off on the basis of the ON/OFF signal received from the MC switch 48, and determination of a currently selected mode (as to whether the excavation mode is the rough excavation mode or the finishing mode) on the basis of the selection mode signal received from the mode selection switch 44. As explained in subsequent embodiments in detail, the excavation mode determination section 302 may automatically select/determine the mode in response to a relationship between the target excavation surface and the claw tip position of the bucket 10 or a value (for example, an arm cylinder pressure) detected by a sensor (not shown)

attached to each actuator. In FIG. 3, determination results of "whether the machine control is turned on or off" and "the excavation mode is the rough excavation mode or the finishing mode" are output to an outside from the excavation mode determination section 302.

The actuator control section 303 outputs command values (boom, arm, and bucket target operating pressures) to the solenoid valve 21 in response to operation amounts (boom, arm, and bucket operating pressures) of the operation levers 1 by the operator, the determination result as to whether the machine control (area limiting excavation control) is turned on or off, the target excavation surface, and the claw tip position of the bucket 10, and drives the three types of hydraulic cylinders 5, 6, and 7 appropriately, thereby allowing the front work device 50 to operate. When the excavation mode determination section 302 determines that the machine control is turned on, the actuator control section 303 prevents the claw tip position of the bucket 10 from entering the area below the target excavation surface. For example, when the operator operates the operation levers 1 and the arm cylinder 6 is expanded to carry out the leveling excavation by means of the arm crowding operation, then the actuator control section 303 can control the boom raising operation by outputting the command value to expand the boom cylinder 5, and control the front work device 50 to operate so that a claw tip locus of the bucket 10 becomes level.

The engine control section 304 outputs a command value (for example, a target engine speed) to an engine controller (not shown) exercising output power control over the engine 22 to control output power of the engine 22 in cooperation with the actuator control section 303 and/or the pump control section 305 as needed. The pump control section 305 is a section that outputs a command value (for example, a target tilting angle determined on the basis of a target pump flow rate and a target pump torque) to a regulator (not shown) exercising output power control over the hydraulic pump 2 in cooperation with the actuator control section 303 and/or the engine control section 304 as needed to thereby control the output power of the hydraulic pump 2.

The engine control section 304 and the pump control section 305 calculate a distance between the target excavation surface and the claw tip (control point) (hereinafter, often referred to as target surface distance) on the basis of the claw tip position (position of the control point) of the bucket 10 and a position of the target excavation surface.

The engine control section 304 often outputs a command value to limit an output power range of the engine 22 to the engine controller on the basis of a combination of whether the machine control is turned on or off, the excavation mode, a moving direction of the bucket 10, and the target surface distance. In that case, the engine control section 304 executes a process (output power limiting process) for imposing more limitations on the output power range of the engine 22 when the target surface distance is equal to or smaller than a threshold D than those when the target surface distance is larger than the threshold D. In the present embodiment, in particular, the engine control section 304 limits the engine output power to a required minimum value for the finishing excavation under the area limiting excavation control by limiting an engine speed. It is noted that the engine control section 304 may change the command value in response to mode information determined by the excavation mode determination section 302.

The pump control section 305 often outputs a command value to limit an output power range of the hydraulic pump 2 to the regulator on the basis of a combination of whether the machine control is turned on or off, the excavation mode, the moving direction of the bucket 10, and the target surface distance. In that case, the pump control section 305 executes a process (output power limiting process) for imposing more limitations on the output power range of the pump 2 when the target surface distance is equal to or smaller than the threshold D than those when the target surface distance is larger than the threshold D. In the present embodiment, in particular, the pump control section 305 limits pump output power to a required minimum value for the finishing excavation under the area limiting excavation control by limiting tilting of the hydraulic pump 2. It is noted that the pump control section 305 may change the target pump flow rate and the target pump torque in response to the mode information determined by the excavation mode determination section 302.

Next, an operation performed by the hydraulic excavator according to the present embodiment will be explained while the leveling excavation (a case in which the target excavation surface is level) is taken by way of example.

At a time of starting excavation, a difference between an actual geographical feature and the target excavation surface is large and the excavation speed takes precedence over the excavation precision to shorten work time. Owing to this, the operator sets the excavation mode to the rough excavation mode by the mode selection switch 44 and carries out work. At this time, it is necessary to allow the actuators 5, 6, and 7 to operate at high speeds without limitations on the output power of the engine 22 and the hydraulic pump 2 for increasing the excavation speed.

Furthermore, after a shape of the target excavation surface is unearthed roughly by the rough excavation work, the excavation precision takes precedence over the excavation speed. Owing to this, the operator sets the excavation mode to the finishing mode by the mode selection switch 44 and carries out work. At this time, it is necessary to lower the output power of the engine 22 and that of the hydraulic pump 2 to the required minimum to reduce operation gains of the actuators 5, 6, and 7 and improve controllability of the machine control for improving the excavation precision. In addition, it is necessary to suppress wasteful consumption of fuel and reduce engine noise by lowering the output power of the engine 22 and that of the hydraulic pump 2 to the required minimum.

Furthermore, when the arm cylinder 6 is contracted to return the bucket 10 to the excavation start point in an aerial operation by means of the arm dumping operation even while the finishing mode is selected as the excavation mode, the excavation speed takes precedence over the excavation precision to shorten the work time. In such a case, it is preferable to allow the actuators 5, 6, and 7 to operate at the high speeds without limitations on the output power of the engine 22 and that of the hydraulic pump 2.

Figure 4:
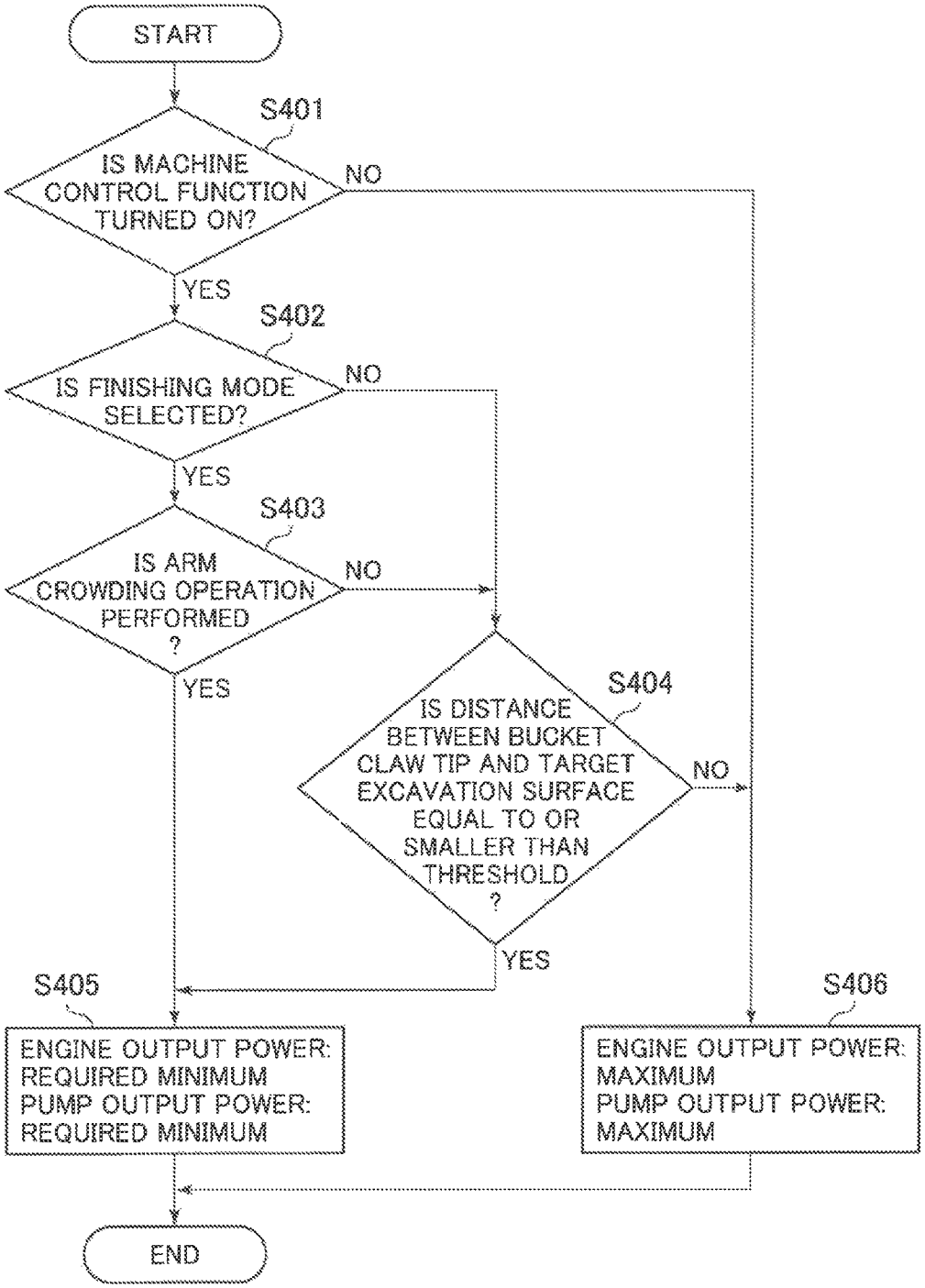
FIG. 4 is a flowchart of processes executed by the control controller according to the first embodiment of the present invention.

FIG. 4 is a flowchart of processes executed by the control controller 40 according to the first embodiment. Processes 405 and 406 out of contents of the processes shown in FIG. 4 are executed by the engine control section 304 and the pump control section 305.

First, in Process 401, the control controller 40 determines whether the machine control function is turned on or off and the control controller 40 goes to Process 402 when the function is turned on. The control controller 40 goes to Process 406 when the function is turned off, and the control controller 40 sets the output power of the engine 22 and that of the hydraulic pump 2 equally to those in a case of operator's manual operation. In an example of FIG. 4, it is assumed that the operator can adjust the engine speed by an engine control dial and the output power of the hydraulic pump 2 is set in response to maximum output power of the engine 22 determined by the adjusted engine speed; thus, the engine output power and the pump output power are set maximum. It is noted that this content of Process 406 is only an example and a content to the effect that the output power ranges of the engine 2 and the hydraulic pump 2 are set larger than those set in Process 405 to be described later is applicable.

Next, in Process 402, the control controller 40 performs the determination of the excavation mode (determination as to whether the excavation mode is the rough excavation mode or the finishing mode), and the control controller 40 goes to Process 403 when the excavation mode is the finishing mode or goes to Process 404 when the excavation mode is not the finishing mode (the excavation mode is the rough excavation mode).

In Process 403, the control controller 40 determines whether the arm crowding operation (operation for expanding the arm cylinder 6) for moving the bucket 10 in a direction in which the bucket 10 is closer to the machine body is performed by detecting the arm operation pilot pressure output by operator's lever operation. The control controller 40 goes to Process 405 when determining that the finishing excavation is carried out upon determination that the arm crowding operation is performed, or goes to Process 404 when determining that the arm crowding operation is not performed.

In Process 404, the control controller 40 determines whether the target surface distance (distance between the bucket claw tip and the target excavation surface) is equal to or smaller than the threshold D. The control controller 40 goes to Process 405 when it is assumed that the claw tip position of the bucket 10 is closer to the target excavation surface and that the finishing work is carried out upon determination that the target surface distance is equal to or smaller than the threshold D. Conversely, the control controller 40 goes to Process 406 when the target surface distance is larger than the threshold D, and sets the output power of the engine 22 and that of the hydraulic pump 2 equal to those in the case of the operator's manual operation.

In Process 405, the control controller 40 executes a process for lowering the output power of the engine 22 and that of the hydraulic pump 2 to the required minimum for preventing the claw tip position of the bucket 10 from entering the target excavation surface. At this time, if the hydraulic pump 2 is configured with a plurality of pumps and one of the pumps can supply the required minimum power, the hydraulic pump 2 is controlled in such a manner that a tilting angle of a predetermined pump increases and tilting angles of the other pumps decrease; thus, it is possible to minimize reduction of efficiency due to a change of the output power of the hydraulic pump 2.

As obvious from the flowchart of FIG. 4, the control controller 40 of the hydraulic excavator according to the present embodiment is configured such that the control controller 40 executes, when the finishing mode (first mode) is selected, (1) the process (output power limiting control (Process 405)) for imposing more limitations on the output power ranges of the engine 22 and the hydraulic pump 2 when the bucket 10 moves in the direction in which the bucket 10 is closer to the hydraulic excavator (the arm crowding operation is performed) or the bucket 10 moves in a direction in which the bucket 10 is farther from the hydraulic excavator (the arm dumping operation is performed) and when the target surface distance is equal to or smaller than the threshold D than those when the target surface distance is larger than the threshold D; and executes, when the rough excavation mode (second mode) is selected, (2) the output power limiting control (Process 405) when the target surface distance is equal to or smaller than the threshold D irrespectively of the moving direction of the bucket 10.

In the hydraulic excavator of the present embodiment configured as described above, the control controller 40 extracts the arm crowding operation (state of carrying out the finishing excavation) in the finishing mode in Processes 402 and 403, and lowers the output power of the engine 22 and that of the hydraulic pump 2 to the required minimum in Process 405. Therefore, the operating speeds of the actuators 5, 6, and 7 decrease and the excavation precision under the machine control can be improved. Furthermore, it is possible to suppress the wasteful consumption of fuel and reduce engine noise by lowering the output power of the engine 22 and that of the hydraulic pump 2 to the required minimum.

Moreover, both the excavation operation (finishing excavation) and the aerial operation without an excavation load (aerial operation for returning the bucket 10 to the excavation start point) are possibly carried out in the arm dumping operation in the finishing mode. In the hydraulic excavator configured as described above, the control controller 40 considers a status in which the bucket claw tip is closer to the target excavation surface (status in which the target surface distance is equal to or smaller than the threshold D) as a status in which the finishing excavation is underway in Process 404, and lowers the output power of the engine 22 and that of the hydraulic pump 2 to the required minimum in Process 405 similarly to the arm crowding operation. In addition, since the control controller 40 considers a status in which the bucket claw tip is farther from the target excavation surface (status in which the target surface distance exceeds the threshold D) as a status in which the aerial operation is underway, and keeps the actuator operating speeds high in Process 404, it is possible to keep high work efficiency.

Furthermore, when the rough excavation mode is selected (the excavation mode is other than the finishing mode), the control controller 40 extracts only the status in which the bucket claw tip is closer to the target excavation surface and lowers the output power in Process 404. Therefore, it is possible to prevent the bucket claw tip from entering the target excavation surface while suppressing reduction of the work efficiency. In addition, when the target surface distance exceeds D and the bucket claw tip is farther from the target excavation surface, then the control controller 40 considers that the operation for returning the bucket 10 to the excavation start point is performed in the aerial operation by means of the arm dumping, and increases the output power of the engine 22 and that of the hydraulic pump 2 in Process 406. Therefore, it is possible to keep the actuator operating speeds high in the rough excavation mode and keep the high work efficiency.

Therefore, the hydraulic excavator according to the present embodiment can ensure the speed in the rough excavation work required of high speed and the operation for returning the bucket 10 to the excavation start point by increasing the output power range of the engine 22 or the pump 2, and facilitate ensuring claw tip precision and achieve energy saving in the finishing work that is not required of high speed by lowering the output power of the engine 22 or the pump 2 to the required minimum.

While Process 405 of FIG. 4 has been explained while referring to a case in which the output power ranges of both the engine 22 and the hydraulic pump 2 are limited to the required minimum values for the purpose of energy saving, an energy saving effect can be also obtained by limiting the output power range of either the engine 22 or the hydraulic pump 2 to the required minimum value. In addition, it is not always necessary to lower the output power range of either the engine 22 or the hydraulic pump 2 to the required minimum value in Process 405 but the output power range of either the engine 22 or the hydraulic pump 2 can be set to an arbitrary range as long as more limitations are imposed on the output range than that in the case of Process 406. Likewise, it is not always necessary to set the output of either the engine 22 or the hydraulic pump 2 to the maximum in Process 406 but the output of either the engine 22 or the hydraulic pump 2 can be set arbitrarily in a range in which the output is higher than that in Process 405.

Moreover, while the moving direction of the bucket 10 is detected by detecting the arm operating pressure in Process 403 described above, the moving direction of the bucket 10 may be detected by detecting the operating pressure of each of or one of the boom 8 and the bucket 10. In another alternative, the moving direction of the bucket 10 can be detected by calculating a temporal change of a position of the bucket 10 calculated on the basis of outputs from the angle sensors 30 to 33. The matters described above are also applicable to subsequent embodiments.

Second Embodiment

Figure 5:
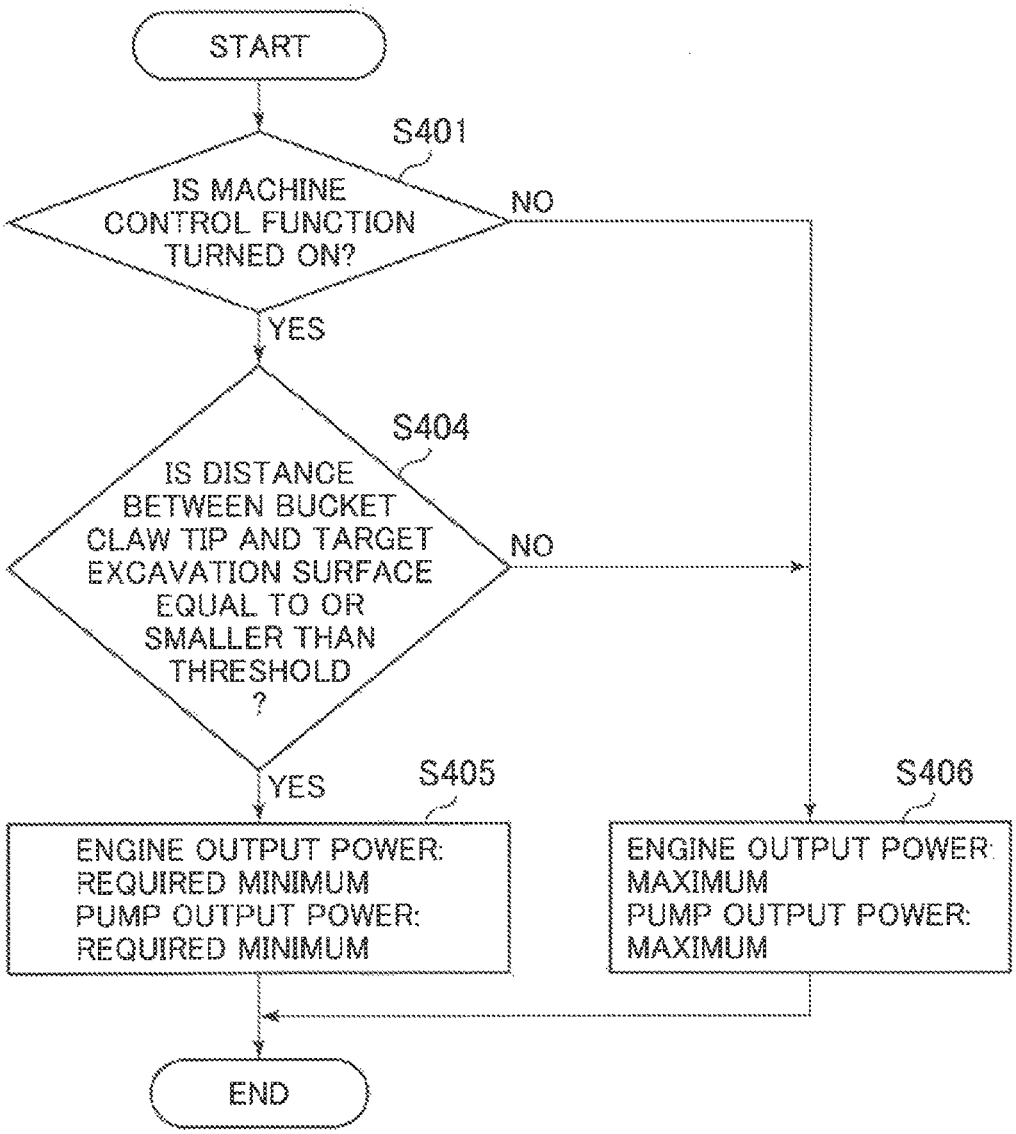
FIG. 5 is a flowchart of processes executed by the control controller according to a second embodiment of the present invention.

Meanwhile, the control is changed over in response to the excavation mode in the example of FIG. 4. Alternatively, the output power of the engine 22 and that of the pump 2 may be limited only on the basis of whether the machine control is turned on or off and the target surface distance irrespectively of the excavation mode. This will be explained next as a second embodiment. FIG. 5 shows a flowchart of processes executed by the control controller 40 according to the second embodiment. However, detailed explanation thereof will be omitted since all the processes in FIG. 5 are already explained with reference to FIG. 4.

In the hydraulic excavator according to the present embodiment, the control controller 40 executes the process (output power limiting control) for imposing more limitations on the output power ranges of the engine 22 and the hydraulic pump 2 when the target surface distance calculated on the basis of the position of the bucket claw tip (control point) and the position of the target surface is equal to or smaller than the threshold D than those when the target surface distance is larger than the threshold D, as shown in the flowchart of FIG. 5. As a result, when the target surface distance is equal to or smaller than the threshold D, the control controller 40 considers that the front work device 50 is in a state of carrying out the finishing excavation and relatively lowers the output of the engine 22 and that the hydraulic pump 2. It is thereby possible to reduce the operation gains of the hydraulic cylinders 5, 6, and 7 and improve controllability over the claw tip of the bucket 10. It is also possible to suppress the wasteful consumption of fuel and reduce engine noise by lowering the output power of the engine 22 and that of the hydraulic pump 2. On the other hand, when the target surface distance exceeds the threshold D, the control controller 40 considers that the aerial operation for returning the bucket 10 to the excavation start point and the rough excavation are carried out, and relatively raise the output power of the engine 22 and that of the hydraulic pump 2. It is thereby possible to keep the actuator operating speeds high and keep the high work efficiency.

Third Embodiment

A third embodiment of the present invention will next be explained with reference to FIGS. 6 and 7.

In the first embodiment shown in FIGS. 1 to 4, the rough excavation mode or the finishing mode is selected as the excavation mode by operator's operating the mode selection switch 44. In the present embodiment, the control controller 40 is configured to automatically select the excavation mode in response to a moving locus of the bucket 10 during the excavation operation. A process in which the control controller 40 selects the excavation mode will be explained below while the leveling excavation is taken by way of example.

Figure 6:
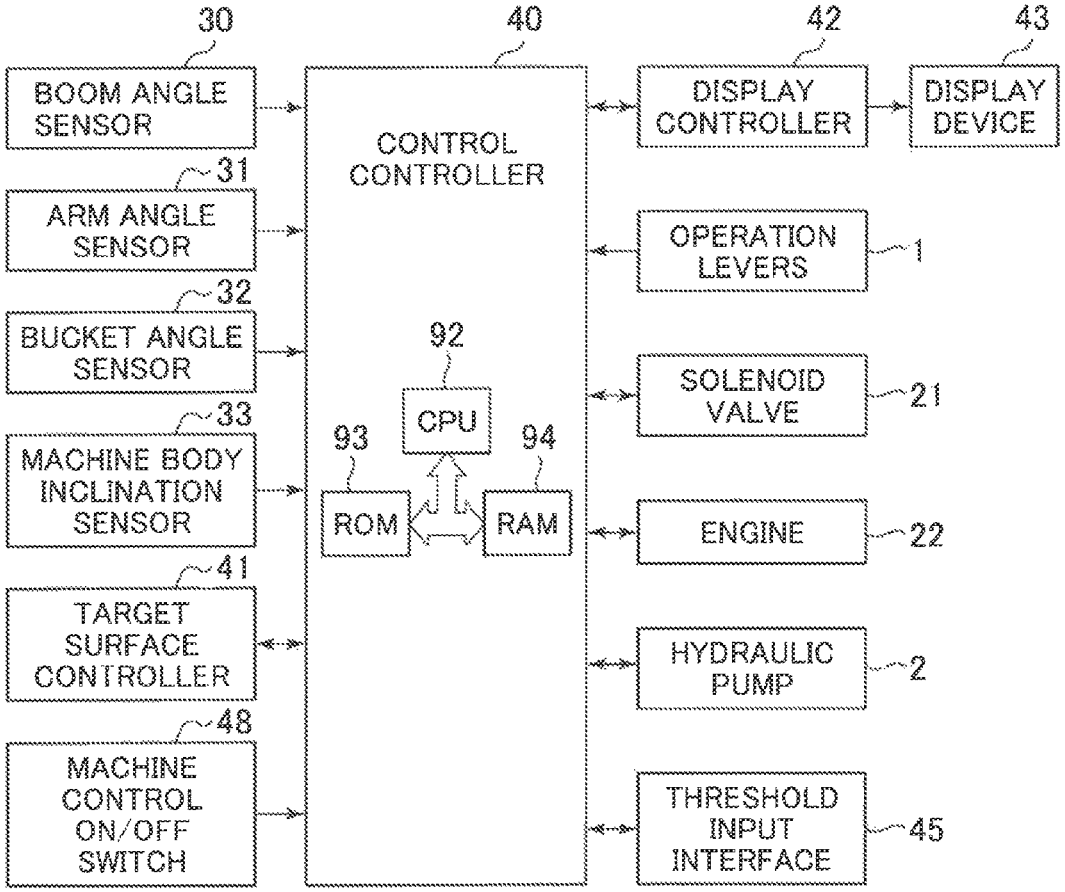
FIG. 6 is a configuration diagram of the control system according to a third embodiment of the present invention.

In the excavation control system shown in FIG. 6, a threshold input interface 45 that is a device for the operator to input a threshold $\alpha$ for changing over the excavation mode is connected to the control controller 40. It is noted that the threshold $\alpha$ may remain a value initially set at shipment of the excavator.

Furthermore, the excavation mode determination section 302 in the control controller 40 compares the shape and a position of the target excavation surface derived from information from the target surface controller 41 with the moving locus and the position of the claw tip of the bucket 10 calculated from the boom angle sensor 30, the arm angle sensor 31, the bucket angle sensor 32, and the machine body inclination sensor 33, and calculates an index that indicates a degree of coincidence between the target excavation surface and the claw tip position of the bucket 10 (degree of coincidence). Since the higher degree of coincidence between the target excavation surface and the claw tip position of the bucket 10 indicates that the claw tip moves near the target excavation surface, accuracy improves for the finishing work. Conversely, since the lower degree of coincidence therebetween indicates that the claw tip moves to positions apart from the target excavation surface, accuracy improves for the rough excavation work. In the present embodiment, a threshold is set to the degree of coincidence and it is estimated whether current work is the finishing work or the rough excavation work on the basis of the threshold.

In the present embodiment, a difference $\delta$ to be described later is calculated as the index that indicates the degree of coincidence, and a threshold $\alpha$ is employed as a threshold for determining whether the excavation mode is the finishing mode or the rough excavation mode. The excavation mode determination section 302 outputs a signal to the power generator control section 310 to set the excavation mode to the finishing mode when the difference $\delta$ is equal to or smaller than the threshold $\alpha$, or outputs a signal to the power generator control section 310 to set the excavation mode to the rough excavation mode when the different $\delta$ exceeds the threshold $\alpha$. It is noted that the threshold $\alpha$ is preferably a value smaller than the threshold D in the first embodiment. For example, when the threshold D is a value in a range of 10 centimeters±3 centimeters, the threshold $\alpha$ is often set to a value in a range of 3 centimeters±2 centimeters. Furthermore, the index that indicates the degree of coincidence is not limited to the difference $\delta$ and another index can be employed as an alternative to the difference $\delta$ if the index can quantitatively represent the degree of coincidence between the target excavation surface and the claw tip position of the bucket 10.

A method of calculating the difference δ during the excavation work according to the present embodiment will be explained. The leveling excavation is carried out by horizontally crowding work by means of the arm crowding operation and the operation for returning the bucket 10 to the excavation start point by means of the arm dumping operation, and a series of operations are defined as one cycle. The difference δ is calculated as an average value of the target surface distances while the horizontally crowding work (arm crowding operation) is carried out in a previous cycle. For example, the difference δ is calculated by integrating the target surface distances (deviations between the target excavation surface and the claw tip of the bucket 10) for a period from start to end of the arm crowding operation by determining whether the arm crowding operation starts or ends, and dividing a resultant integral value by operating time to determine the average value.

Figure 7:
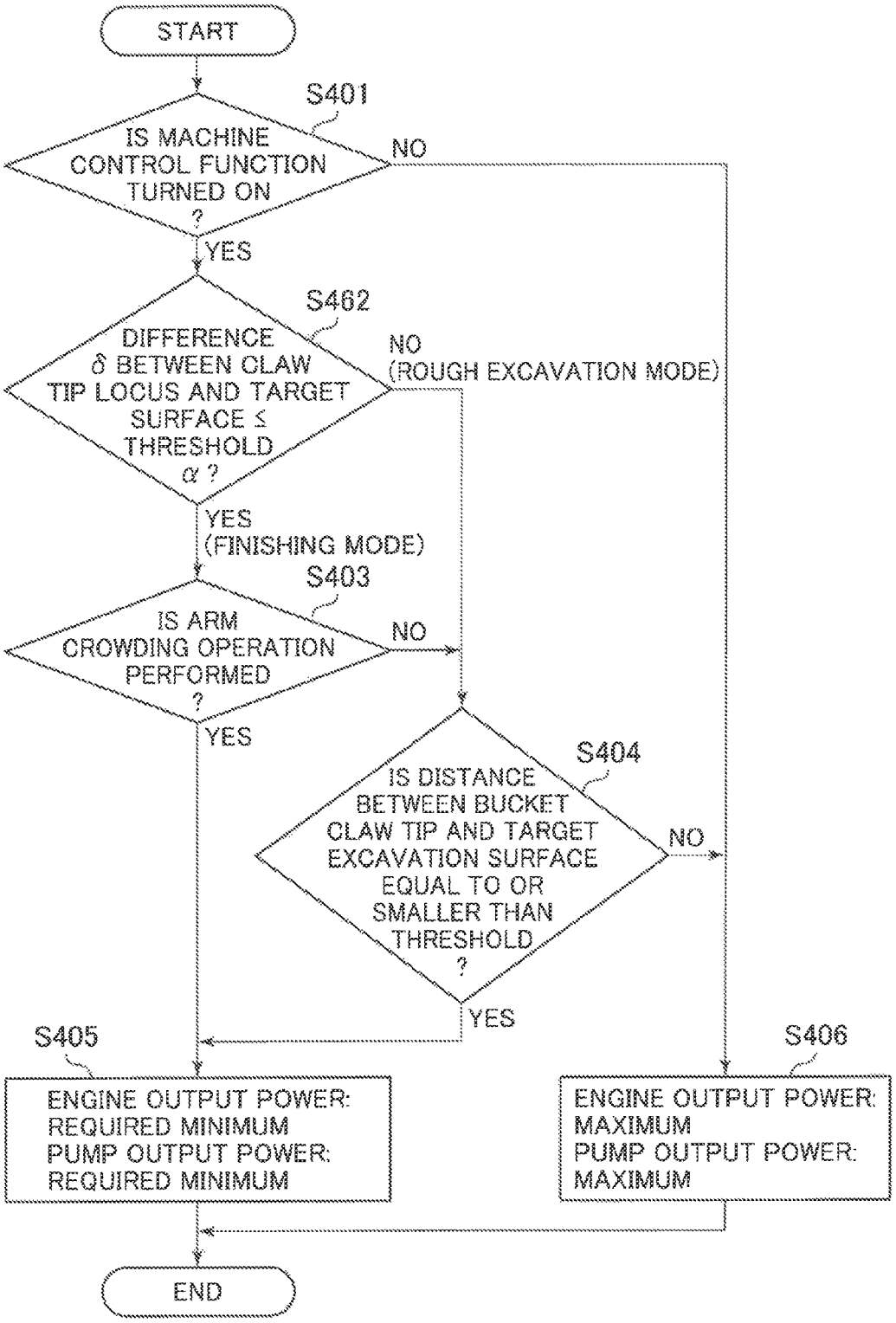
FIG. 7 is a flowchart of processes executed by the control controller according to a third embodiment of the present invention.

FIG. 7 is a flowchart of processes executed by the control controller 40 according to the third embodiment.

In the flowchart of FIG. 4 described above, the control controller 40 determines whether the excavation mode is the finishing mode in Process 402. In the flowchart of FIG. 7, by contrast, the control controller 40 is configured to change over the control in response to the difference δ between the target excavation surface and a claw tip locus of the bucket 10 in Process 462.

At the time of starting excavation, the difference between the actual geographical feature and the target excavation surface is large, so that the difference δ between the target excavation surface and the claw tip locus of the bucket 10 is larger than the threshold α. At this time, the control controller 40 sets the excavation mode to the rough excavation mode in accordance with Process 462 shown in the flowchart of FIG. 7.

When the shape of the target excavation surface is unearthed roughly by the rough excavation work, the difference δ between the target excavation surface and the claw tip position of the bucket 10 becomes equal to or smaller than the threshold α. When the difference δ from the target area for the leveling excavation work becomes equal to or smaller than the threshold α, the control controller 40 sets the excavation mode to the finishing mode at a time of next excavation work.

In this way, it is possible to automatically change over a control method by the control controller 40 depending on a magnitude relationship between the difference δ between the bucket claw tip position and the target excavation surface and the threshold α.

Fourth Embodiment

A fourth embodiment of the present invention will next be explained with reference to FIGS. 8 and 9.

In the third embodiment shown in FIGS. 6 and 7, the excavation mode is changed over on the basis of the difference δ between the target excavation surface and the claw tip position of the bucket 10 and the threshold α. In the present embodiment, by contrast, the excavation mode is changed over on the basis of a pressure (load pressure) P of the arm cylinder 6 out of the three types of hydraulic cylinders 5, 6, and 7. This configuration uses a phenomenon that the pressure P of the arm cylinder 6 becomes relatively high since the excavation load is relatively high during the rough excavation but the pressure P of the arm cylinder 6 becomes relatively low since the excavation load is relatively low during the finishing excavation.

In the present embodiment, a threshold β is set to the cylinder pressure P and it is estimated whether current work is the finishing work or the rough excavation work on the basis of the threshold β. The excavation mode determination section 302 outputs a signal to the power generator control section 310 to set the excavation mode to the finishing mode when the cylinder pressure P is equal to or lower than the threshold β, or outputs a signal to the power generator control section 310 to set the excavation mode to the rough excavation mode when the cylinder pressure P exceeds the threshold β.

A method of calculating the arm cylinder pressure P during the excavation work according to the present embodiment will be explained. Similarly to the third embodiment, it is defined that a series of operations, i.e., the arm crowding operation and the arm dumping operation are one cycle for the leveling excavation. The arm cylinder pressure P is calculated as an average value while the horizontally crowding work is carried out in a previous cycle. For example, the arm cylinder pressure P is calculated by integrating values of an arm cylinder pressure sensor 46 for a period from start to end of the arm crowding operation by determining whether the arm crowding operation starts or ends, and dividing a resultant integral value by the operating time to determine the average value.

Figure 8:
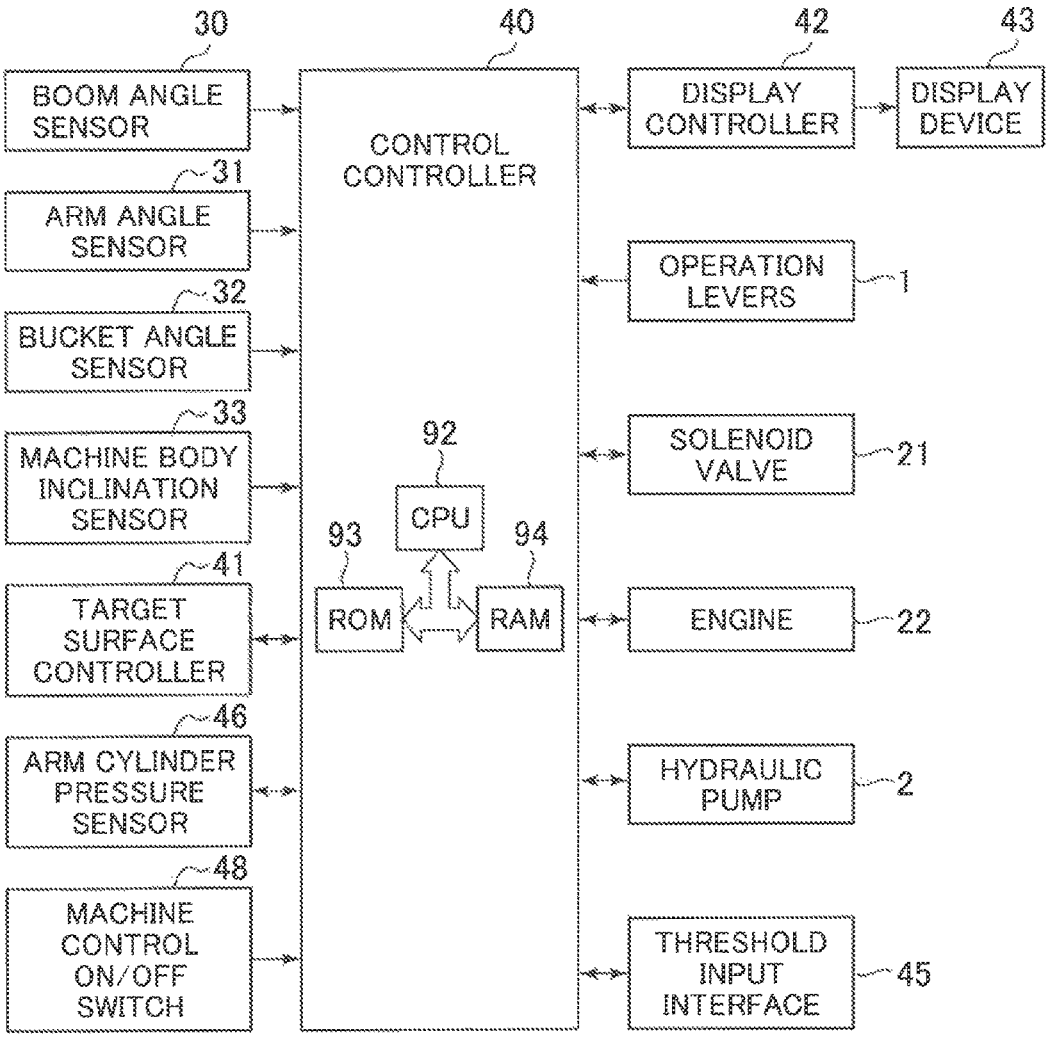
FIG. 8 is a configuration diagram of the control system according to a fourth embodiment of the present invention.

In the excavation control system shown in FIG. 8, the arm cylinder pressure sensor 46 provided in a hydraulic line for supplying and discharging the hydraulic fluid to and from the arm cylinder 6 or in the arm cylinder 6 is connected to the control controller 40 in addition to the configuration of FIG. 6. In addition, the excavation mode determination section 302 in the control controller 40 compares the arm cylinder pressure P with the pressure threshold β. It is noted that the pressure threshold β may remain a value initially set at the shipment although the operator can input the pressure threshold β via the threshold input interface 45 similarly to the third embodiment.

Figure 9:
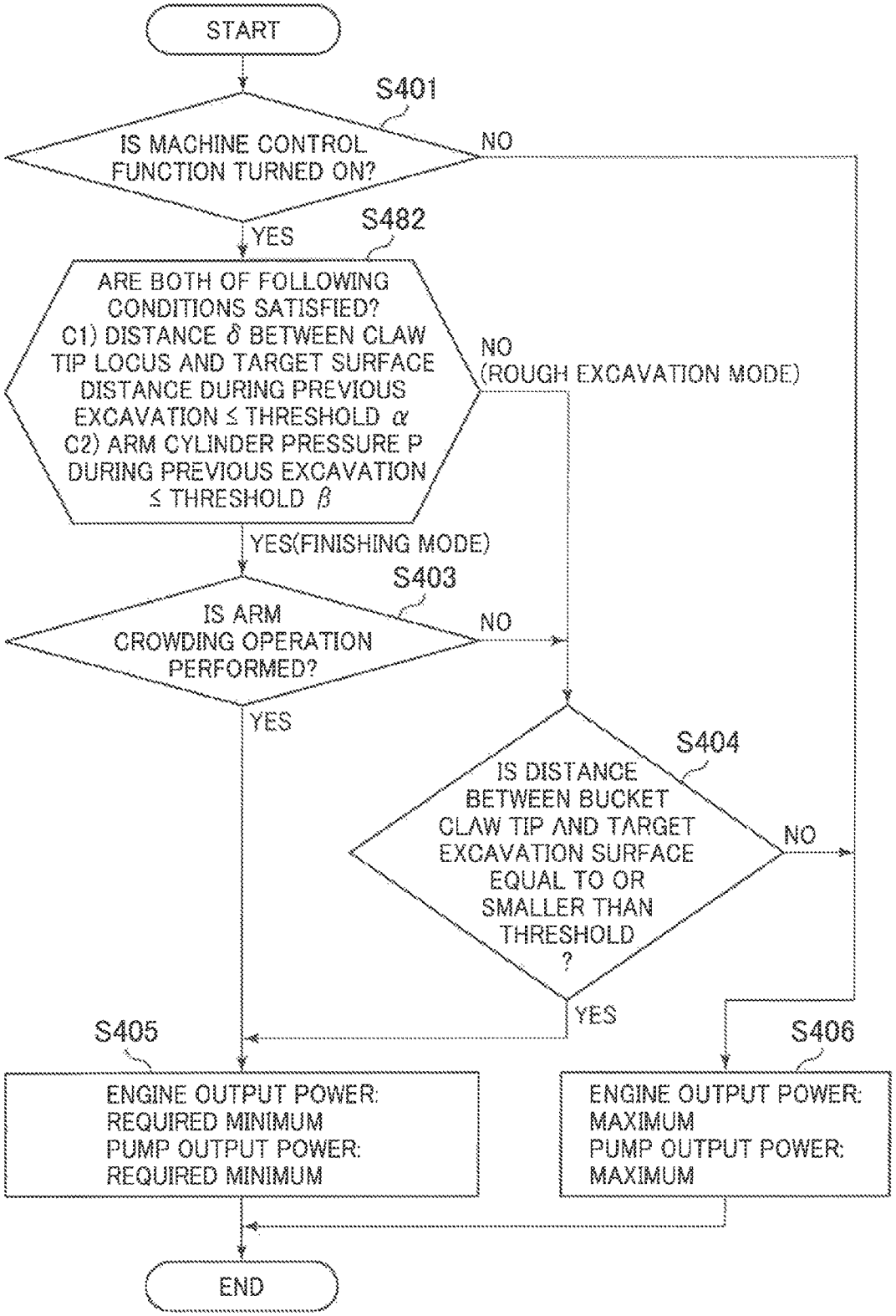
FIG. 9 is a flowchart of processes executed by the control controller according to the fourth embodiment of the present invention.

FIG. 9 is a flowchart of processes executed by the control controller 40 according to the fourth embodiment.

In the flowchart of FIG. 9, the control controller 40 changes over the control on the basis of a condition for the arm cylinder pressure P (a magnitude relationship between the pressure P and the threshold β) in addition to a determination condition (the magnitude relationship between the difference δ and the threshold α) in Process 462 shown in the flowchart of FIG. 7.

At the time of starting excavation, the difference between the actual geographical feature and the target excavation surface is large (difference δ>threshold α) and it is necessary to excavate the ground deeply. Owing to this, the arm cylinder 6 is heavily loaded during the excavation operation by means of the arm crowding. The arm cylinder pressure P thereby has a value higher than the threshold β. At this time, the control controller 40 sets the excavation mode to the rough excavation mode in accordance with Process 482 shown in the flowchart of FIG. 9, and then goes to Process 404.

When the shape of the target excavation surface is unearthed roughly by the rough excavation work, then the difference δ becomes equal to or smaller than the threshold α, the load of the arm cylinder 6 becomes lighter, and the arm cylinder pressure P becomes equal to or lower than the threshold β. At this time, the control controller 40 sets the excavation mode to the finishing mode in accordance with Process 482 shown in the flowchart of FIG. 9, and then goes to Process 403.

In the present embodiment, it is possible to determine a work situation more accurately since the excavation mode is changed over using not only the distance-based difference δ between the claw tip of the bucket 10 and the target excavation surface but also the arm cylinder pressure. It is thereby possible to change the output power range of the engine 22 or the hydraulic pump 2 more appropriately than the third embodiment.

In the present embodiment, both the difference δ and the pressure P are used for automatic changeover of the excavation mode for the purpose of improving determination precision for the work situation. Alternatively, the excavation mode may be changed over only on the basis of the magnitude relationship between the pressure P and the threshold β.

Furthermore, in the present embodiment, the excavation mode is automatically set using only the pressure (load pressure) of the arm cylinder 6 out of the three types of hydraulic cylinders 5, 6, and 7. Alternatively, the excavation load may be determined and the excavation mode may be set using a pressure (load pressure) of each of or one of the boom cylinder 5 and the bucket cylinder 7 in addition to or as an alternative to the pressure of the arm cylinder 6.

The present invention is not limited to the embodiments described above but encompasses various modifications. For example, the abovementioned embodiments have been described in detail for describing the present invention so that the present invention is easy to understand. The present invention is not always limited to the examples having all the configurations explained so far. In addition, the configuration of a certain embodiment can be partially replaced by the configuration of another embodiment or the configuration of another embodiment can be added to the configuration of the certain embodiment. Moreover, for a part of the configuration of each embodiment, addition, deletion, and/or replacement of the other configuration can be made.

For example, while the angle sensors that detect the angles of the boom 8, the arm 9, and the bucket 10 are used for calculating the claw tip position of the bucket 10 in the embodiments, the claw tip position may be detected using not the angle sensors but cylinder stroke sensors. Moreover, setting of the target excavation surface by the target surface controller 41 may be made such that drawing information is stored in the memory within the control controller 40 in advance or such that the operator manually inputs the drawing information.

Furthermore, the configuration such that the claw tip position of the bucket 10 is assumed as the control point and control is exercised in response to the distance between the control point and the target excavation surface in the embodiments. However, a comparison target which is the control point and of which the distance from the target excavation surface is calculated is not always limited to the claw tip position of the bucket 10 but may be a rear surface of the bucket 10. Moreover, when the bucket link 13 is closer to the target surface than the bucket 10 depending on the posture of the front work device 50, the comparison target of which the distance from the target excavation surface is calculated may be set to the bucket link 13.

Furthermore, the excavation control system may be configured such that the currently selected excavation mode is displayed in the display section 43 to explicitly show the excavation mode for the operator.

DESCRIPTION OF REFERENCE CHARACTERS

1: Operation lever
2: Hydraulic pump
5: Boom cylinder
6: Arm cylinder
7: Bucket cylinder
8: Boom
9: Arm
10: Bucket
13: Bucket link
21: Solenoid valve
22: Engine
30: Boom angle sensor
31: Arm angle sensor
32: Bucket angle sensor
33: Machine body inclination sensor
40: Control controller
41: Target surface controller
42: Display controller
44: Mode selection switch
45: Threshold input interface
46: Arm cylinder pressure sensor
48: Machine control ON/OFF switch
301: Control point position calculation section
302: Excavation mode determination section
303: Actuator control section
305: Pump control section
310: Power generator control section

The invention claimed is:

1. A construction machine comprising:

a prime mover;

a hydraulic pump driven by power generated by the prime mover;

a work device that operates by a plurality of hydraulic actuators driven by power generated by the hydraulic pump, the work device including a work tool on a tip end thereof; and an actuator control section that controls at least one of the plurality of hydraulic actuators in such a manner that a tip end of the work tool is located on or above a target surface that is arbitrarily set, a control point position calculation section that calculates a position of a control point set with respect to the work device on the basis of quantities of state related to a position and a posture of the work device; and a power generator control section that, when a distance between the target surface and the control point calculated on the basis of the position of the control point and a position of the target surface is equal to or smaller than a threshold, executes output power limiting control that is a process for imposing more limitations on an output power range of at least one of the prime mover and the hydraulic pump than when the distance between the target surface and the control point is larger than the threshold, wherein the power generator control section is configured to be able to alternatively select:

a first mode of executing the output power limiting control when the work tool moves in the direction in which the work tool is closer to the construction machine, or when the work tool moves in the direction in which the work tool is farther from the construction machine and when the distance between the target surface and the control point is equal to or smaller than the threshold; or a second mode of executing the output power limiting control when the distance between the target surface and the control point is equal to or smaller than the threshold irrespective of a moving direction of the work tool, the construction machine further comprising:

a changeover device that outputs to the power generator control section a signal for alternatively changing over between the first mode and the second mode in response to a changeover position.

2. The construction machine according to claim 1, wherein the output power limiting control is a process for limiting a revolution speed of the prime mover to limit an output power range of the prime mover.

3. The construction machine according to claim 1, wherein the output power limiting control is a process for limiting tilting of the hydraulic pump to limit an output power range of the hydraulic pump.

4. A construction machine comprising:

a prime mover;

a hydraulic pump driven by power generated by the prime mover;

a work device that operates by a plurality of hydraulic actuators driven by power generated by the hydraulic pump, the work device including a work tool on a tip end thereof; and an actuator control section that controls at least one of the plurality of hydraulic actuators in such a manner that a tip end of the work tool is located on or above a target surface that is arbitrarily set, a control point position calculation section that calculates a position of a control point set with respect to the work device on the basis of quantities of state related to a position and a posture of the work device; and a power generator control section that, when a distance between the target surface and the control point calculated on the basis of the position of the control point and a position of the target surface is equal to or smaller than a threshold, executes output power limiting control that is a process for imposing more limitations on an output power range of at least one of the prime mover and the hydraulic pump than when the distance between the target surface and the control point is larger than the threshold, wherein the power generator control section is configured to be able to alternatively select:

a first mode of executing the output power limiting control when the work tool moves in the direction in which the work tool is closer to the construction machine, or when the work tool moves in the direction in which the work tool is farther from the construction machine and when the distance between the target surface and the control point is equal to or smaller than the threshold; or a second mode of executing the output power limiting control when the distance between the target surface and the control point is equal to or smaller than the threshold irrespective of a moving direction of the work tool, the construction machine further comprising:

a mode determination section that outputs to the power generator control section a signal for alternatively changing over between the first mode and the second mode on the basis of a degree of coincidence between a moving locus of the work tool and a shape and a position of the target surface during excavation work by the work device.

5. The construction machine according to claim 4, wherein the output power limiting control is a process for limiting a revolution speed of the prime mover to limit an output power range of the prime mover.

6. The construction machine according to claim 4, wherein the output power limiting control is a process for limiting tilting of the hydraulic pump to limit an output power range of the hydraulic pump.

7. A construction machine comprising:

a prime mover;

a hydraulic pump driven by power generated by the prime mover;

a work device that operates by a plurality of hydraulic actuators driven by power generated by the hydraulic pump, the work device including a work tool on a tip end thereof; and an actuator control section that controls at least one of the plurality of hydraulic actuators in such a manner that a tip end of the work tool is located on or above a target surface that is arbitrarily set, a control point position calculation section that calculates a position of a control point set with respect to the work device on the basis of quantities of state related to a position and a posture of the work device; and a power generator control section that, when a distance between the target surface and the control point calculated on the basis of the position of the control point and a position of the target surface is equal to or smaller than a threshold, executes output power limiting control that is a process for imposing more limitations on an output power range of at least one of the prime mover and the hydraulic pump than when the distance between the target surface and the control point is larger than the threshold, wherein the power generator control section is configured to be able to alternatively select:

a first mode of executing the output power limiting control when the work tool moves in the direction in which the work tool is closer to the construction machine, or when the work tool moves in the direction in which the work tool is farther from the construction machine and when the distance between the target surface and the control point is equal to or smaller than the threshold; or a second mode of executing the output power limiting control when the distance between the target surface and the control point is equal to or smaller than the threshold irrespective of a moving direction of the work tool, the construction machine further comprising:

a controller that includes the actuator control section, the control point position calculation section, and the power generator control section, wherein the controller further includes a mode determination section that outputs to the power generator control section a signal for alternatively changing over between the first mode and the second mode in response to a load pressure of one of the plurality of hydraulic actuators.

8. The construction machine according to claim 7, wherein the output power limiting control is a process for limiting a revolution speed of the prime mover to limit an output power range of the prime mover.

9. The construction machine according to claim 7, wherein the output power limiting control is a process for limiting tilting of the hydraulic pump to limit an output power range of the hydraulic pump.

* * * * *